US005603558A

United States Patent [19]

Zimmer

[11] Patent Number: 5,603,558

[45] Date of Patent: Feb. 18, 1997

[54] TREASURE BOX

[76] Inventor: Linda L. Zimmer, 42 Skyline Dr., Highland Mills, N.Y. 10930

[21] Appl. No.: 338,643

[22] Filed: Nov. 10, 1994

[51] Int. Cl.[6] ..... A47B 81/00

[52] U.S. Cl. ..... 312/290; 312/311; 312/322; 312/351; 312/204; 206/566

[58] Field of Search ..... 312/204, 234, 312/348.3, 351, 290, 310, 311, 322; 206/6.1, 566; 40/661, 722, 723

[56] References Cited

U.S. PATENT DOCUMENTS

| | | | |
|---|---|---|---|
| D. 200,017 | 1/1965 | Williams . | |
| D. 203,305 | 12/1965 | Ax . | |
| D. 212,661 | 11/1968 | Gigliuto . | |
| D. 264,896 | 6/1982 | Perkins . | |
| D. 281,837 | 12/1985 | Lin . | |
| D. 319,155 | 8/1991 | Powell . | |
| D. 333,487 | 2/1993 | Papp . | |
| D. 335,577 | 5/1993 | Malmanger . | |
| 1,778,406 | 10/1930 | Sundee | 206/566 |
| 2,268,637 | 1/1942 | Bernstein . | |
| 2,718,326 | 9/1955 | Le Blanc . | |
| 3,186,529 | 6/1965 | Gilbert . | |
| 4,269,461 | 5/1981 | Roach, Jr. . | |
| 4,659,154 | 4/1987 | Jenkins | 312/290 |
| 4,787,516 | 11/1988 | Morrison | 206/566 |
| 4,854,064 | 8/1989 | Yamaguchi | 40/661 |

FOREIGN PATENT DOCUMENTS

| | | | |
|---|---|---|---|
| 0460514 | 1/1937 | United Kingdom | 312/351 |

OTHER PUBLICATIONS

Bloomingdale's Christmas Catalogue by Mail 1994 p. 37.

*Primary Examiner*—Peter M. Cuomo
*Assistant Examiner*—Anthony D. Barfield
*Attorney, Agent, or Firm*—Sandra M. Kotin

[57] ABSTRACT

A box that can be given as a gift or special presentation or to commemorate a special event. The box is fitted with shelves and trays that can be arrranged in a variety of ways so as to contain objects of different sizes and shapes. An insert for a tray provides a flexible array of smaller compartments. A covered plate fitted with straps allows various articles to be held securely thereto. An easily removable reversible front panel must be raised to change the interior arrangement of shelves and trays and also provides a surface for decoration or commemorative indicia. A picture frame demountably attached to the top of the box can be used to hold an invitation, special message or photograph. Areas are provided within the box to store some of the components when they are not in use. The addition of a knife holding unit and suitable adjustment of the components enables the box to be used to store table flatware. The non-obvious nature of the removable front panel and the flexible nature of the components allows for secret compartments. Inventory sheets and number tabs permit a running inventory of the box's contents.

17 Claims, 4 Drawing Sheets

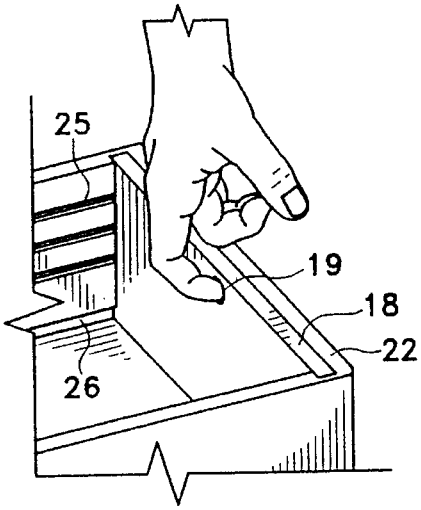
Fig. 4
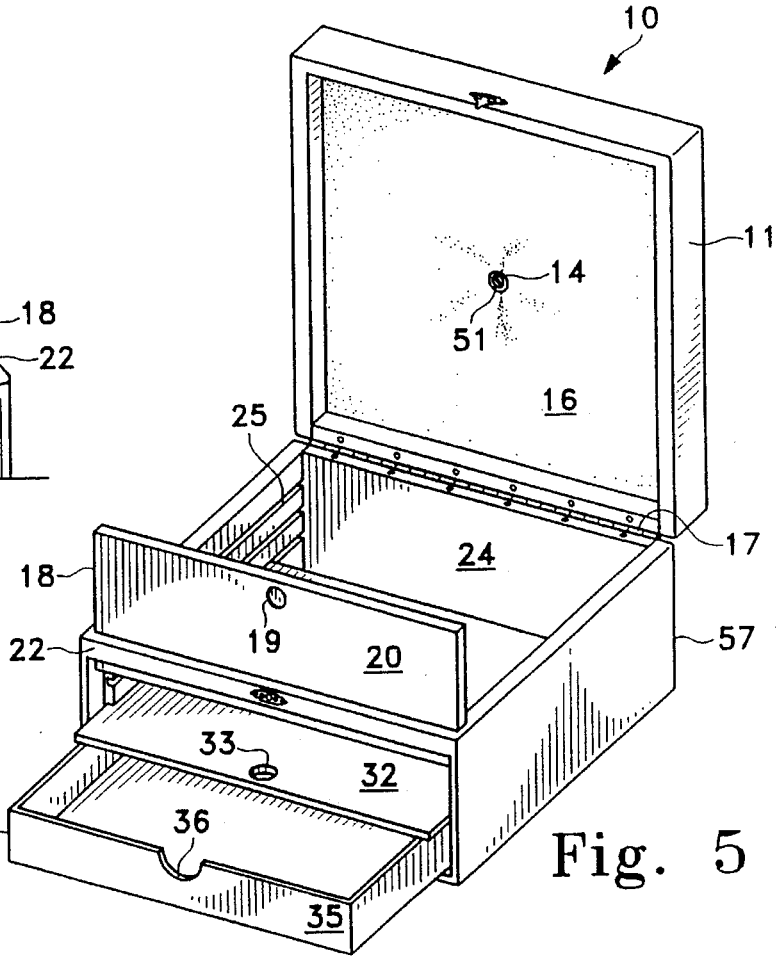
Fig. 5
Fig. 6
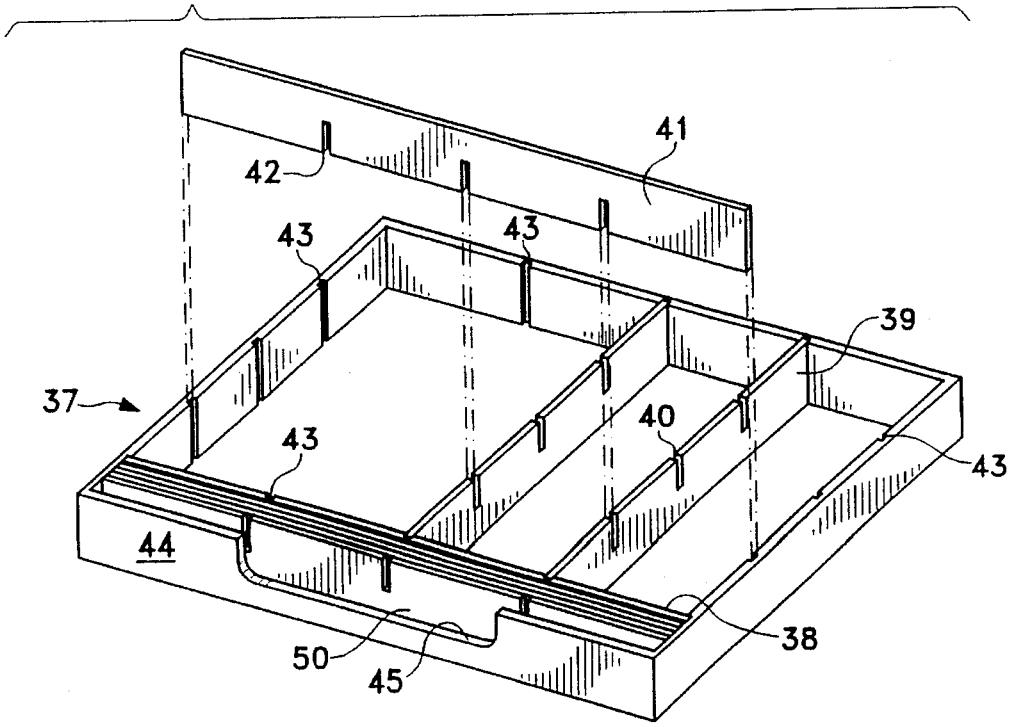

TREASURE BOX

FIELD OF THE INVENTION

The instant invention relates to a box for the storage of a wide range of items. The uses of the box can vary since it can be used as one single chamber, two chambers, or a combination of shelves and drawers. A variety of objects of different sizes can be accommodated. The interior arrangement can easily be changed at the whim of the user. A detachable picture frame and reversible front panel provide for commemorative indicia.

BACKGROUND OF THE INVENTION

There have been a wide variety of boxes receiving utility and design patents. These boxes have been made for many different purposes, from general storage to being fitted for specific and narrowly defined uses. Such boxes, however, cannot be easily altered, if in fact any alteration is possible, for uses different from those for which they were devised and constructed.

Williams (U.S. Des. No. 200,017) designed a decorative jewelry box that has a storage bar inside the cover, a padded or fabric lined tray and two padded or fabric lined drawers that open out from the front of the box. The jewelry box of Ax (U.S. Des. No. 203,305) has a divided upper tray and a swing-out lower semicircular partitioned tray that could be considered a secret compartment.

Gigliuto (U.S. Des. No. 212,661) has designed a vanity case with a mirror on the inside of the cover. The upper portion of the box is made up of a series of compartments of different dimensions. Below are two layers of drawers that open from the front of the box. The front side of the drawers and upper compartments are transparent so that their contents are visible from the front of the box.

The tool box of Perkins (U.S. Des. No. 264,896) is a tall box with a lid that opens to rest at the back of the box and which contains a compartment which is closed by a hinged panel. The front of the box is hinged and opens outward exposing a large chamber containing a shelf with holes to support tools and a sectioned tray resting on the bottom. Beneath this chamber is a sectioned drawer that opens from the front of the box, beneath the hinged front portion. Lin's tool box (U.S. Des. No. 281,837) also has a lid that opens all the way back so it is out of the way of access to the contents of the upper single chamber. The front of the box is hinged and opens completely to hang downward from the surface on which the box rests. There are three levels of small drawers and one large covered drawer that are exposed when the front is lowered.

Powell (U.S. Des. No. 319,155) develped a jewelry armoire that opens from the center front with two doors that are each flamed from within and have hooks at the top and a fabric pouch at the bottom. There are four compartmented trays or drawers within the main chamber. The tackle storage system of Maimanger (U.S. Des. No. 335,577) has a compartmented front panel that opens down to reveal a series of drawers.

None of the aforementioned boxes has any flexilibility as to the arrangements of the drawers or sections. They are all designed for a specific purpose and can only be used for another purpose if the items to be stored therein are similar to those for which the boxes were originally designed.

The compartmented storage box of Papp (U.S. Des. No. 333,487) has two removable trays and a sectioned bottom. It is possible to use the box without one or both trays but the sculptured sections in the bottom designed to hold pastels cannot be removed.

The travel case of Gilbert (U.S. Pat. No. 3,186,529) and the Christmas tree trim cabinet of Roach, Jr. (U.S. Pat. No. 4,269,461) have a series of drawers or trays that can be removed, but both inventions are not really designed to be used without the drawers since permanently mounted flanges support them.

There is a necessity for a storage box that allows the user to choose the interior arrangement to fit the needs of the moment and which can be changed to accommodate changing times and needs. There is also a necessity for a box that can be used to commemorate a specific event or to remember a particular person by having a picture or special printed matter such as an invitation or personal message on the outside of the box as well as a scene or verse. There is also a need for a box that can be so arranged as to provide hidden sections to store private notes or other materials.

BRIEF SUMMARY OF THE INVENTION

Special boxes are often given as gifts to commemorate an event such as a wedding, birth or anniversary; to memorialize a deceased person; or to honor an employee, friend or relative. Such boxes are usually a simple well made wooden box with a lid that opens to reveal a single chamber or one removable tray with a compartment beneath the tray. A brass plaque may be attached to the top or front of the box with the recipient's name, the date and a company name or other notation.

When a box is given as a gift, the giver, or presenter, does not usually know what the recipient will want to place in the box. There are no presentation boxes with an interior arrangement that can be changed to fit the whims and needs of the user. Such a box should be capable of holding items such as jewelry, notes and letters, audio and video tapes, photographs, books, diaries, and small figurines. The box of the present invention can be adjusted to hold any one of these things, several of any one, or a combination of such items. The interior of the box of the present invention can also be arranged to store table flatware.

There is a picture frame affixed to the top of the box to hold a drawing or photograph or such printed material as a wedding invitation or birth announcement. The picture frame may also be removed if desired. A reversible front panel can be engraved with a design or special message. The interior of the box accepts a flexible arrangement of shelves and trays so that objects of differing sizes and shapes can be accommodated. This flexibility also enables the use of the box to change so that it can hold a variety of objects at different periods over a lifetime.

It is an object of the present invention to have a box that can be used as a presentation gift to commemorate a vast number of special life occurrences.

It is another object of the present invention to have a box with a reversible front panel that is easily removed to provide access to the interior and is not obvious so that the box can have "secret compartments".

Another object of the invention is to have complete flexibility of the design of interior of the box so that the user can set the shelves and trays to fit his or her individual needs.

A further object of the present invention is to include a catalogue and numbered stickers so that a complete inventory of the contents of the box can be kept at all times.

A still further object of the present invention is to provide places within the box to store some of the removable parts when not in use.

A further object of the present invention is to have the box and its removable parts constructed so that most of the changes to the interior arrangement are quickly and easily affected without special skills or tools of any kind.

Another object of the present invention is be able to change the appearance of the box by reversing the front panel.

A still further object of the invention is to have a box that can be made of a number of different materials and still maintain the integrity of the invention.

Further objects and advantages of the present invention will become apparent from the following description and drawings.

BRIEF DESCRIPTION OF THE DRAWINGS

FIG. 4 is a cut away view of the interior of the box showing how the front panel is removed.

FIG. 5 is a front perspective view of the opened box showing the front panel partially raised and one shelf and one tray.

FIG. 6 is an exploded perspective view of the partition insert for a tray with some partitions in place and others in the storage area.

DETAILED DESCRIPTION OF THE INVENTION

Figure 1:
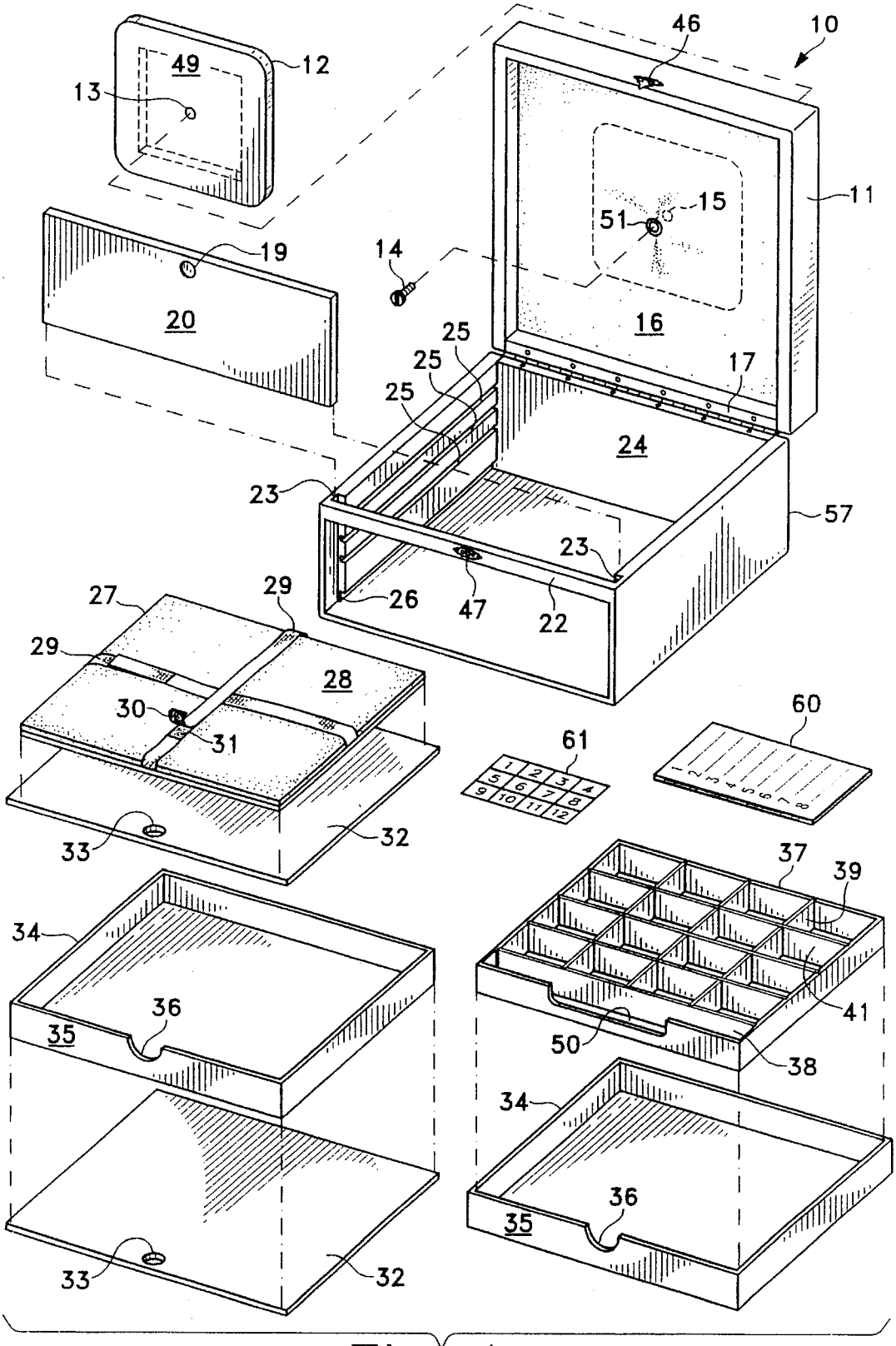
FIG. 1 is an exploded perspective view of the box of the present invention.

The treasure box 10 of the present invention as seen in FIG. 1 consists of a box 57 having a bottom, two side walls, a back wall 24, and a front wall 22 with most of the central portion cut out to form a frame behind which rests a removable and reversible front panel 18. Vertical grooves 23 along the interior front edge of each of the side walls accommodate the reversible front panel 18. The panel 18 has one blank side 20 that matches the exterior of the box and a design side 21 which may be merely the reverse of the panel with the same finish and having a design or letters painted or engraved thereon or it may have a contrasting finish or an overlay with a design or letters affixed thereto. Both the blank side 20 and the design side 21 of the panel 18 have an indentation 19 at the top center for ease of removal of the panel from the box.

To remove or reverse the front panel 18 one need only open the box and place a finger into the indentation 19 in the side of the panel facing into the box and lift the panel as seen in FIG. 4. The panel is easily slidable in the vertical grooves 23. The indentation 19 in the side facing out cannot be seen when the panel is in place because it is covered by the upper member of the cut out front wall 22. One viewing the closed box would not know that the front panel 18 is removable. (See FIGS. 2 and 3) The framed effect appears to be aesthetic only.

The cover member or lid 11 of the treasure box 10 is constructed of a framed panel designed such that the frame sides are flush with the sides of the box 57 when the lid 11 is closed. This framed panel design provides a recessed area within the lid 11. A removable plate 16 is fitted into the recess and rests against the interior surface 58 of the lid 11. The side of the plate 16 facing the interior of the box 57 is padded. (FIG. 7) Small objects can be pinned to the padding and it provides a soft surface when stored objects come in contact with the inside of the lid.

The lid 11 is pivotally attached to the box 57 along the upper edge of the back wall 24 by a hinge 17. A clasp or lock 46 is affixed at the center of the front of the lid 11 and there is a reciprocal portion 47 of the clasp or lock affixed at the center of the upper member of the front wall 22. Such clasps and locks are well known in the art.

Figure 2:
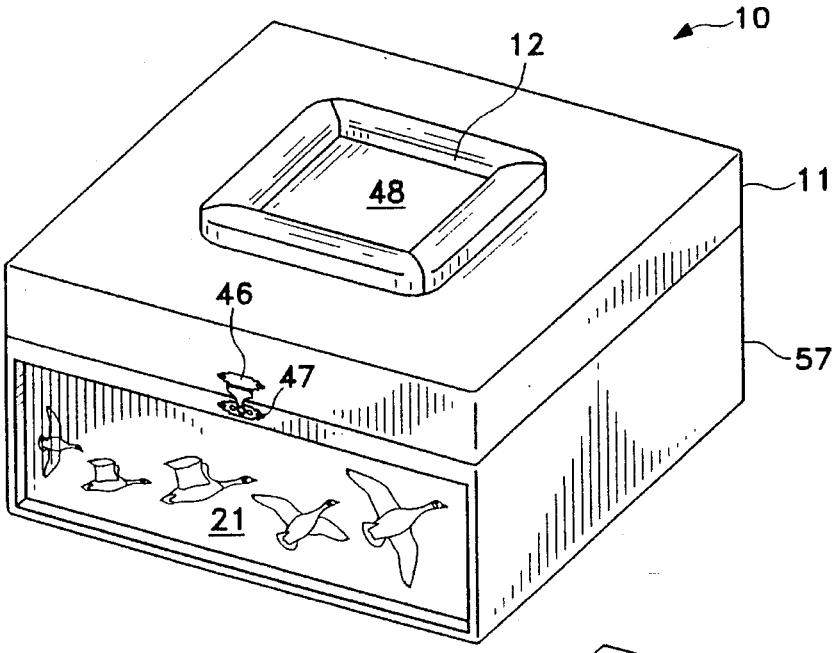
FIG. 2 is a front perspective view of the box with the design side of the front panel showing.
Figure 3:
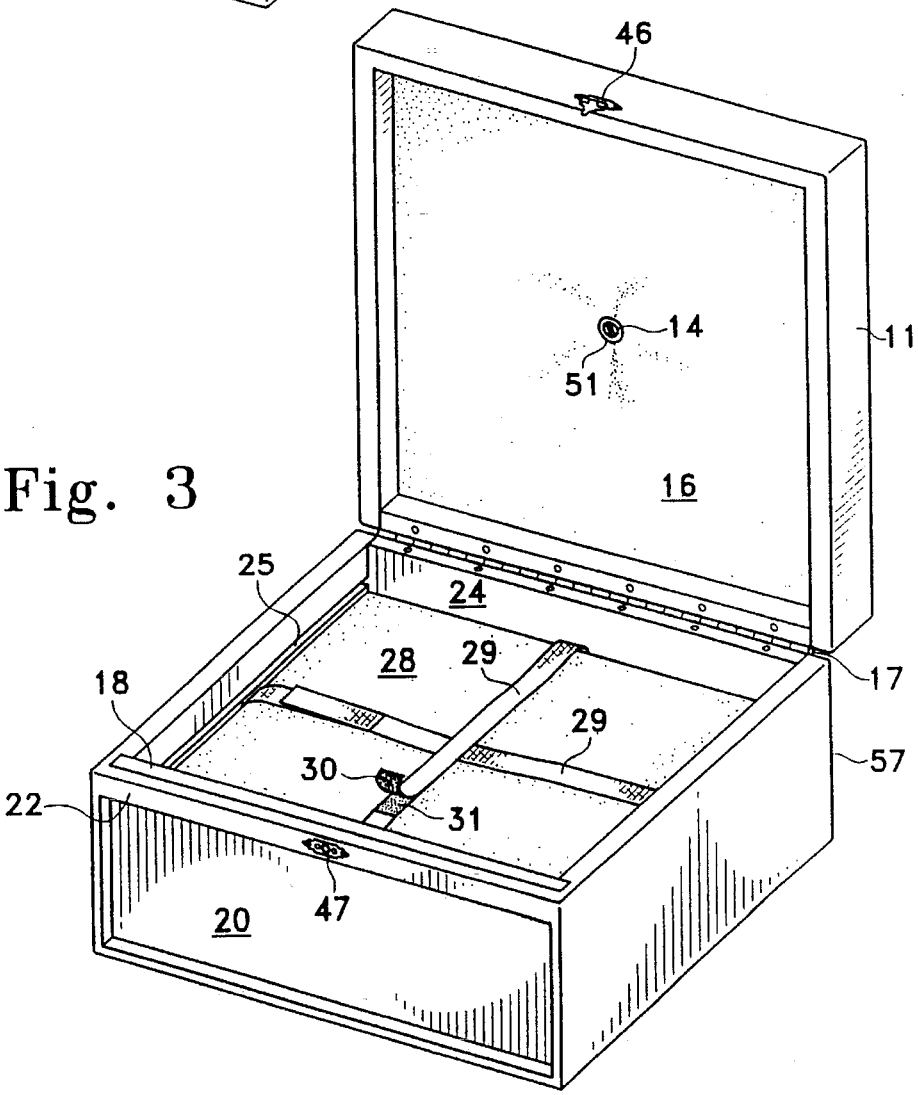
FIG. 3 is a front perspective view of the box with the lid opened and with the solid front panel showing.

A picture frame 12 is fastened to the exterior top center of the lid 11 by means of a bolt 14 which passes from the inside of the box through a grommet 51, an opening 15 in plate 16, the center of lid 11 through an opening 59, and into a threaded recess 13 in the underside 49 of the picture frame 12. (FIG. 1) The frame is removable and a finial or other decoration can be affixed by the bolt 14. The picture frame is fitted with a glass or other transparent protector 48 in the usual manner. (FIG. 2)

Figure 7:
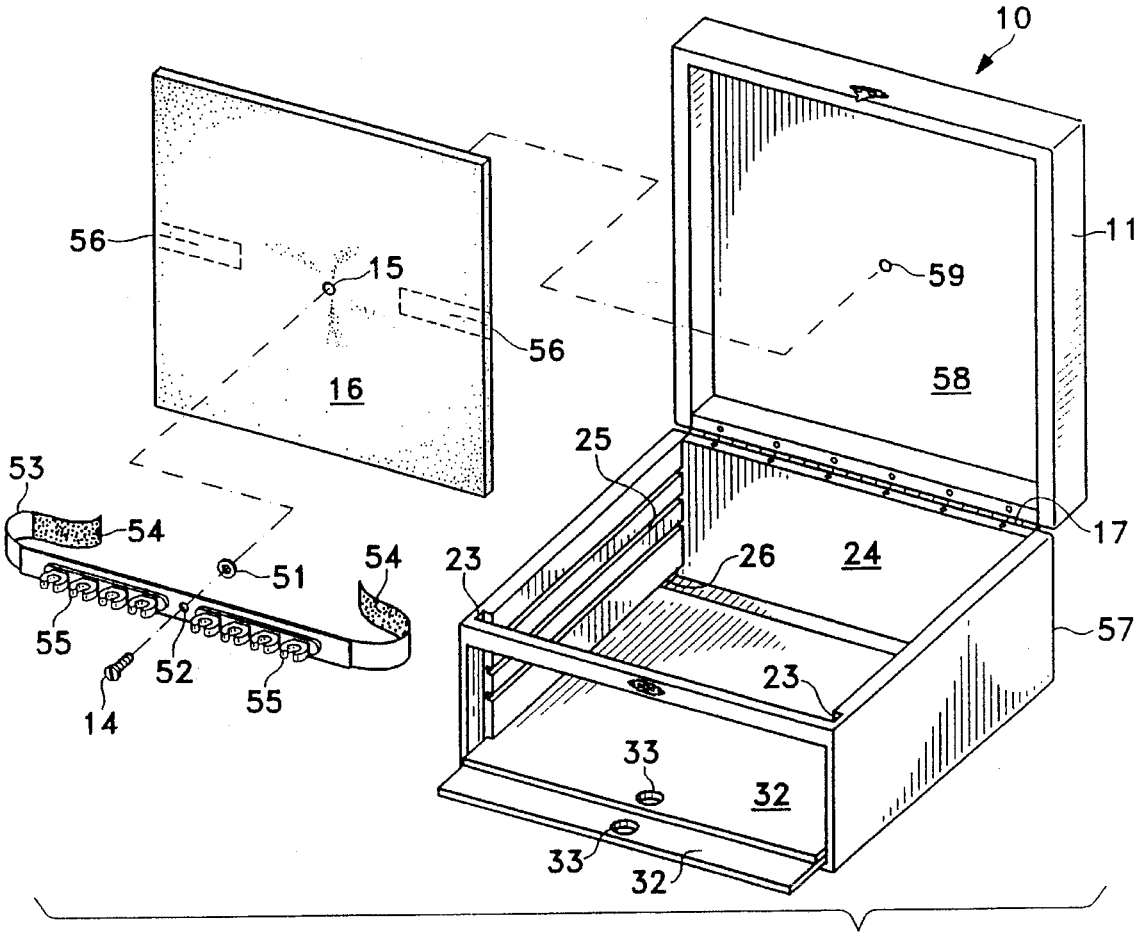
FIG. 7 is an exploded perspective view of the opened box showing the two shelves being stored at the bottom and the knife holder strap and padded interior lid plate.

Opposing each other in the interior surface of each side wall of the box 57 are three horizontal grooves 25. There are also opposed recesses 26 along the bottom edge of the interior of each side wall. (FIG. 1) The treasure box is supplied with two divider shelves 32 each of which can be slid into a set of opposing grooves 25 to divide the main chamber of the box 57. Each shelf has a small cutout 33 in the center near the front edge for ease of removal. The opposed recesses 26 along the bottom of the interior side walls are for storage of one or both of the shelves 32 when they are not in use, as seen in FIG. 7.

The treasure box 10 contains two identical trays 34 which consist of a bottom panel surrounded by a back wall, two side walls and a front wall 35. The trays 34 are designed to rest on the shelves 32, or a tray can rest on the bottom of the box 57. The front wall 35 of each tray has a centrally disposed notch 36 in the upper edge for ease of removal of the tray from the box.

To enable storage of photographs, letters, video tapes, small books or other flat materials, a covered plate 27 is provided. (FIGS. 1 and 3) This plate is covered on both surfaces and is fitted with straps to hold the objects. The embodiment illustrated has four straps 29. One strap 29 is attached at the center of each edge of the plate. The opposed straps form a pair. The free end of one member of each pair has a strip of hook-type fastener 30 on its under surface. On the upper surface of the other member of the pair, near the point of attachment, is a strip of loop-type fastener 31. The straps can be crossed over the upper surface 28 of the plate 27 and each pair of straps joined by coaction of the fastener strips to hold the flat materials securely. Plate 27 can be placed on top of a tray 34, it can rest on a shelf 32, or on the bottom of the box.

In one of many possible arrangements of the box components, one tray 34 rests on the bottom of the box and one shelf 32 is placed in the lowermost set of grooves 25 as shown in FIG. 5. The other tray can then be placed on the shelf. The covered plate 27 can be placed on top of the tray 34. Thereafter, when the box is opened, the covered plate is seen (as in FIG. 3) and nothing under it is visible. In another arrangement the other shelf can be placed into the uppermost set of grooves and is then seen when the box is opened. The solid surface of the upper shelf conceals everything else in the box.

When a shelf is placed in the uppermost set of grooves a tray can still be placed upon it. There is sufficient room for this because the flamed nature of the lid accepts the upper portion of the tray. To create a third section in the box the second tray can rest on the bottom of the box and the second shelf can be placed in the set of grooves immediately above it. That will leave a narrow area between the two shelves where papers or a small book can be kept. Many other arrangements of the components are possible.

As can be observed in FIGS. 5 and 7, the front panel 18 must be raised or removed in order to insert or remove the trays and shelves. This is also necessary when objects are to be placed therein. The removable front panel 18 enables the user of the treasure box 10 to arrange the trays and shelves to maintain "secret compartments" or "secret storage areas" within the box since it is impossible to see beyond the upper layer without raising the front panel.

To permit ordered storage of small objects in a tray, a removable partitioned insert 37 is provided which can be used to form compartments of various sizes or shapes. This can be seen in FIG. 1 and in detail in FIG. 6. The partitioned insert 37 fits well into either tray. The insert 37 consists of a frame having a front wall 44, a back wall and two side walls. A longitudinal fixed slat 38 is permanently attached to the interior of the side walls at points near the front wall 44, and parallel thereto, forming a storage area 50. This fixed slat 38 has one surface facing the storage area 50 and the other surface facing the interior of the partitioned insert 37. There are three equidistantly spaced vertical grooves 43 in the interior surface of each of the back wall, side walls and fixed slat 38. These grooves 43 divide each wall into four equal sections. Three transverse slats 39 and three longitudinal slats 41 can be slidably positioned in these grooves 43 to form a variety of storage compartments.

The transverse slats 39 have three equidistantly spaced upward facing slots 40 in their upper halves, and the longitudinal slats 41 have three equidistantly spaced downward facing slots 42 in their lower halves so the slats can interlock where they cross. Combinations using one or more of the slats are possible, resulting in different numbers of compartments of different dimensions. If all of the slats are used there are sixteen equivalent compartments formed. The storage area 50 can be used to store any of the removable partition slats when they are not needed. There is a horizontal cut out portion 45 centered in the upper area of the front wall 44 for ease of removal of the stored slats and to remove the partition insert 37 from a tray 34. (FIGS. 1 and 6)

Figure 8:
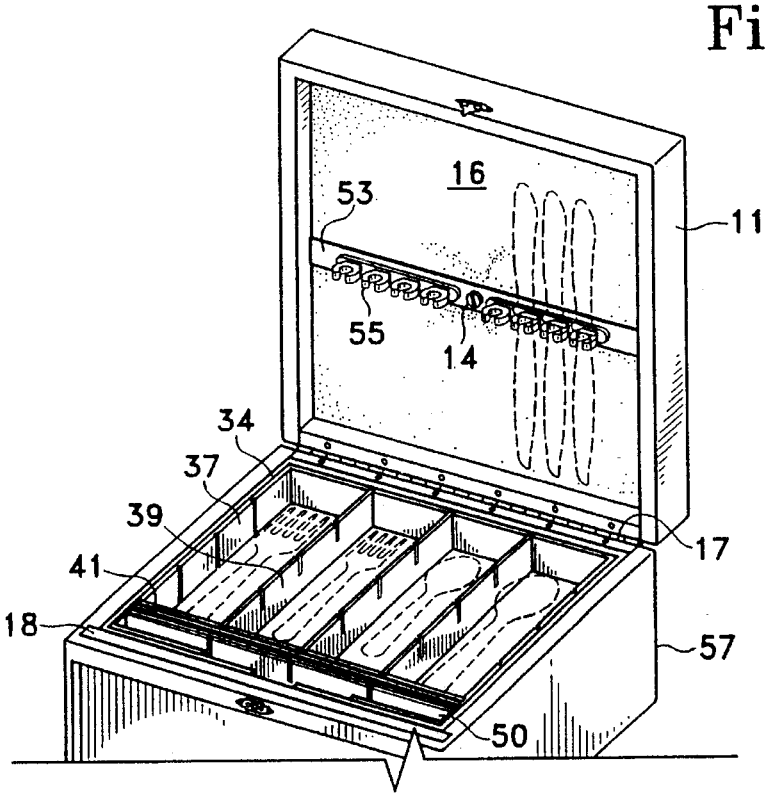
FIG. 8 is a cut away perspective view of the opened box showing how table flatware can be accommodated.

The treasure box 10 can be modified to hold table flatware with the addition of a holding device for knives which attaches to the interior of the lid. The holding device consists of a strap 53 made of a strong, flexible material. Two sets of clips 55 are permanently mounted on either side of the center point of the strap 53. The clips 55 are specifically designed to hold knives and are well known in the art. A small aperture 52 in the center of the strap 53 enables to be fastened by means of bolt 14 through the lid 11. (See FIG. 7) There are strips of hook-type fastener 54 attached to each end of strap 53 on the back surface. The ends of the strap are turned under plate 16 and coact with strips of loop-type fastener 56 affixed appropriately to the back side of the plate 16. The trays and shelves can thereafter be used as needed to hold the rest of the flatware. One arrangement is seen in FIG. 8.

To enable the user to keep a complete record of the contents of the box, a set of inventory sheets 60 and peel-off numbers 61 are included. The user can place a number on each object stored in the box and record the item in the appropriately numbered space on the inventory sheets.

The treasure box 10 can be made of many different varieties of wood to provide different qualities to the finished product. It may also be made of polymeric materials, metals or pressed board. Thus the price to manufacture the treasure box can range from inexpensive to very costly. The box can also be made in many different sizes and dimensions and may have only one tray, shelf and partitioned insert, or two or more of any or all of these interior components.

While one embodiment of the instant invention has been illustrated and described in detail it is to be understood that this invention is not limited thereto and may be otherwise practiced within the scope of the following claims.

I claim:

1. A storage case having a variable arrangement of interior components for storage of articles exhibiting a wide range of sizes and shapes, said storage case comprising:

a box having a bottom, two side walls, a back wall and a front wall, each having an interior face and an exterior face, said front wall being in the form of a rectangular frame;

a reversible panel situated in back of said front wall:

vertical groove means at the front edges of the interior faces of said side walls and adjacent said front wall into which said reversible panel is slidably disposed such that it may be easily raised, removed, reversed and replaced;

at least one tray member for receiving the articles to be stored therein;

at least one removable shelf member capable of supporting said tray member whereby a series of opposed horizontal support means on the interior faces of said side walls slidably accommodate said shelf member at varying elevations, and said horizontal support means being accessible when said reversible panel is raised;

means within said box for the storage of said shelf member when not in use;

a top member pivotally attached to the upper edge of said back wall, said top member having an interior and an exterior surface; and a picture frame demountably attached to the exterior surface of the top member.

2. A storage case as in claim 1 wherein the reversible front panel has a contrasting surface with commemorative indicia on one side.

3. A storage case as in claim 1 containing a removable insert for use with said tray member, said insert having adjustable partition members so as to form varying numbers of compartments of different sizes and shapes and further having storage means for storing adjustable partition members not in use.

4. A storage case having a variable arrangement of interior components for storage of articles exhibiting a wide range of sizes and shapes, said storage case comprising:

a box having a bottom, two side walls, a back wall and a front wall, each having an interior face and an exterior face, said front wall being in the form of a rectangular frame;

a reversible panel situated in back of said front wall;

vertical groove means at the front edges of the interior faces of said side walls and adjacent said front wall into which said reversible panel is slidably disposed such that it may be easily raised, removed, reversed and replaced;

at least one tray member for receiving the articles to be stored therein;

a removable insert for use with said tray member, said insert having adjustable partition members so as to form varying numbers of compartments of different sizes and shapes and further having means for storing adjustable partition members not in use;

at least one removable shelf member capable of supporting said tray member whereby a series of opposed horizontal support means on the interior faces of said side walls slidably accommodate said shelf member at varying elevations, said horizontal support means being accessible when said reversible panel is raised;

opposed recesses along the bottom edges of the interior faces of said sidewalls, said recesses being for storage of said shelf member when not in use;

a plate member for placement on said tray member;

a top member pivotally attached to the upper edge of said back wall, said top member having an exterior surface and a recessed interior capable of accommodating the upper portion of a tray member; and a picture frame demountably attached to the exterior surface of the top member.

5. A storage case as in claim 4 wherein the reversible front panel has a contrasting surface with commemorative indicia on one side.

6. A storage case as in claim 4 wherein the horizontal support means are grooves in the interior faces of said side walls.

7. A storage case as in claim 4 containing means to maintain inventory of the contents of said box.

8. A storage case as in claim 4 further comprising a removable plate member fitted into the recessed interior of said top member, said removable plate member being padded on the side facing the interior of said box.

9. A storage case as in claim 4 further comprising demountable means to hold knives such that said case can be used to store table flatware, said knife holding means being attached to the interior of said top member.

10. A storage case having a variable arrangement of interior components for storage of articles exhibiting a wide range of sizes and shapes, said storage case comprising:

a box having a bottom, two side walls, a back wall and a front wall, each having an interior face and an exterior face, said front wall being in the form of a rectangular frame;

a reversible panel having a different appearance on each side and being situated in back of said front wall;

vertical groove means at the front edges of the interior faces of said side walls and adjacent said front wall into which said reversible panel is slidably disposed such that it may be easily raised, removed, reversed and replaced;

at least one tray member for receiving the articles to be stored therein;

at least one removable insert for use with said tray member, said insert having adjustable partition members so as to form varying numbers of compartments of different sizes and shapes and further having means for storing adjustable partition members not in use;

at least one removable shelf member capable of supporting said tray member whereby a series of opposed horizontal support means on the interior faces of said side walls slidably accommodate said shelf member at varying elevations, said horizontal support means being accessible when said reversible panel is raised;

opposed recesses along the bottom edges of the interior faces of said sidewalls, said recesses being for storage of said shelf member when not in use;

a plate member, for placement on said shelf member, covered on both sides to provide a soft surface such that articles can be placed thereon and having strap means affixed thereto capable of holding flat articles;

a top member being pivotally attached to the upper edge of said back wall, said top member having an exterior and a recessed interior capable of accommodating the upper portion of a tray member;

a picture frame demountably attached at the center of the exterior of the top member for holding presentation indicia or photographs; and clasp means affixed to the exterior front center of the top member and cooperating means affixed to the upper center of the exterior face of the front wall to maintain closure of the storage case.

11. A storage case as in claim 10 wherein the reversible front panel has a contrasting surface with commemorative indicia on one side.

12. A storage case as in claim 10 wherein the horizontal support means are grooves in the interior faces of said side walls.

13. A storage case as in claim 10 containing means to maintain inventory of the contents of said box.

14. A storage case as in claim 13 wherein the means to maintain inventory comprises numbered lined sheets for listing said inventory and numbered tabs to adhere to each article inventoried.

15. A storage case as in claim 10 further comprising a removable plate member fitted into the recessed interior of said top member, said removable plate member being padded on the side facing the interior of said box.

16. A storage case as in claim 16 further comprising demountable means to hold knives such that said case can be used to store table flatware, said knife holding means being attached to the interior of said top member.

17. A storage case as in claim 10 wherein said removable insert further comprises:

a rectangular frame having a front wall, a back wall and two side walls, each having an interior face and an exterior face;

a longitudinal divider, having a front face and a back face, being permanently affixed to the interior faces of the two side walls near the front wail and parallel thereto, said divider forming a storage area adjacent said front wall;

a plurality of longitudinal slats each having multiple downward facing slots in their lower halves;

a plurality of transverse slats each having multiple upward facing slots in their upper halves such that said transverse slats can interlock with said longitudinal slats to form compartments, and whereby the number of slats in use determines the number and sizes of the resulting compartments;

a series of opposed vertical grooves in the interior faces of the side walls, said grooves being capable of slidably receiving said longitudinal slats;

a series of opposed vertical grooves in the interior face of the back wall and the back face of the divider, said grooves being capable of slidably receiving said transverse slats; and said storage area being for placement of longitudinal slats and transverse slats that are not in use.

* * * * *